United States Patent [19]

Creasy et al.

[11] Patent Number: 4,875,287

[45] Date of Patent: Oct. 24, 1989

[54] SHAVING ARTICLES LUBRICIOUS WHEN WET AND COMPOSITIONS THEREFOR

[75] Inventors: Walter S. Creasy, Bridgewater; Donald H. Lorenz, Basking Ridge, both of N.J.

[73] Assignee: Hydromer, Inc., Whitehouse, N.J.

[21] Appl. No.: 931,399

[22] Filed: Nov. 14, 1986

[51] Int. Cl.[4] ..... B26B 21/44

[52] U.S. Cl. ..... 30/34.01; 30/90; 30/41; 525/127

[58] Field of Search ..... 30/41, 90; 428/425.8; 525/127

[56] References Cited

U.S. PATENT DOCUMENTS 4,100,309 7/1978 Micklus et al. .
4,119,094 10/1978 Micklus et al. .
4,170,821 10/1979 Booth .
4,381,293 4/1983 Michel ..... 30/90 X
4,624,051 11/1986 Apprille, Jr. et al. .

FOREIGN PATENT DOCUMENTS 2024082 1/1980 United Kingdom .

*Primary Examiner*—Frank T. Yost
*Assistant Examiner*—Michael D. Folkerts

[57] ABSTRACT

The present invention is a shaving article such as a shaving cartridge which includes at least one blade and a blade support having a skin-engaging portion adjacent to a shaving edge of the blade. The skin-engaging portion is provided with a hydrogel comprising a water soluble polymer bound so as to prevent dissolution whereby the coefficient of friction of the skin-engaging portion is reduced in the presence of water.

28 Claims, 1 Drawing Sheet

Fig. 1
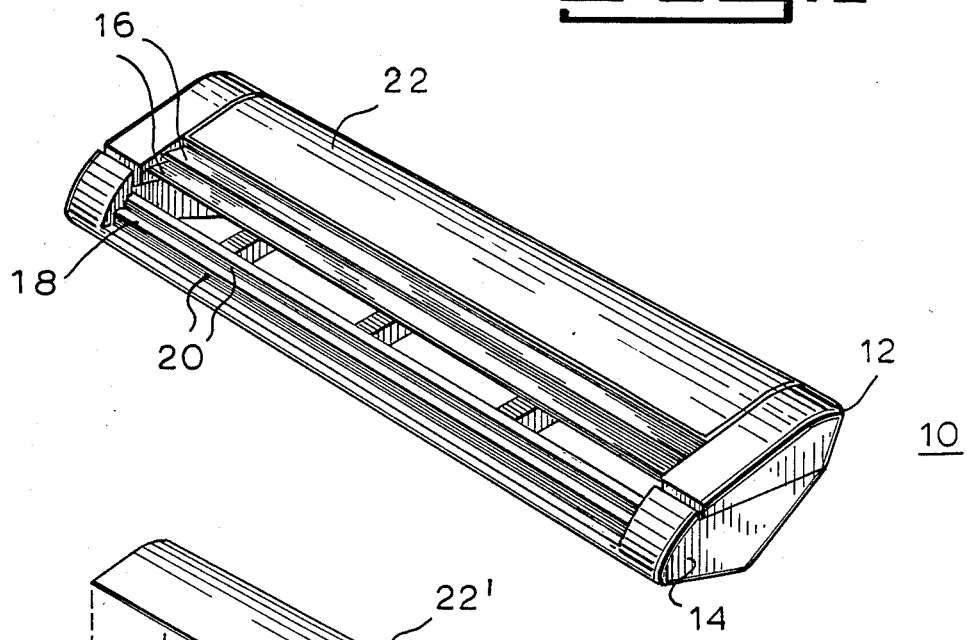
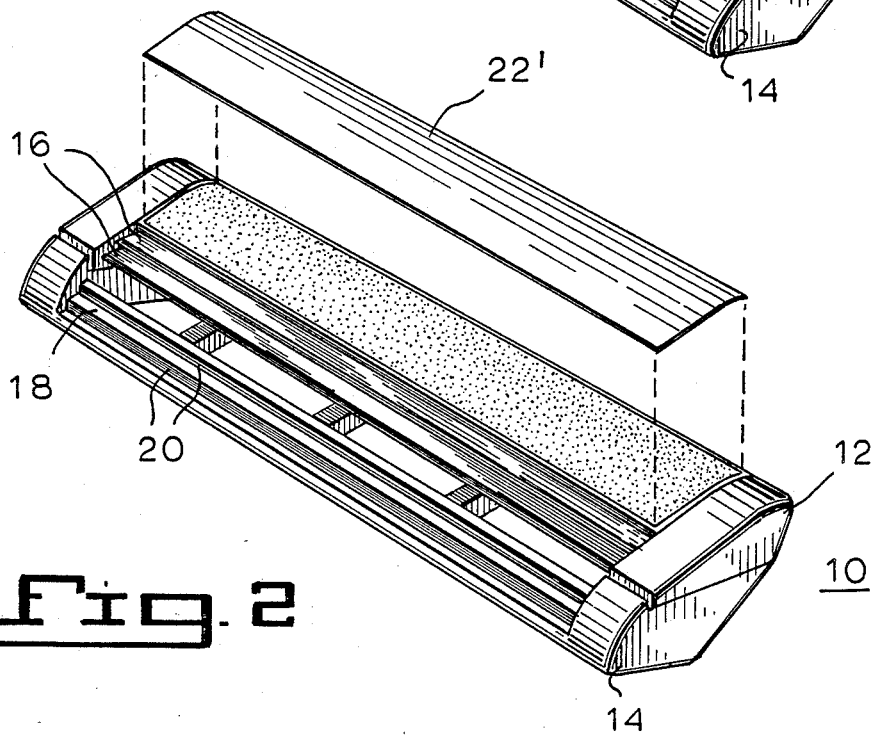
Fig. 2

SHAVING ARTICLES LUBRICIOUS WHEN WET AND COMPOSITIONS THEREFOR

BACKGROUND OF THE INVENTION

The present invention relates to the art of shaving, and, in particular, to improving the ease with which a shaving cartridge can be drawn across the skin during shaving.

In wet-shaving razor systems, there are several factors which can contribute to discomfort during shaving. Such factors include frictional drag of the razor across the skin, the force needed to sever the hair which, in turn, depends on, among other things, the mechanical strength of the hair protein structure, and clogging of the razor parts with whisker and skin debris. Other detracting factors relate to skin conditions such as rashes, eruptions, and previously-inflicted nicks and cuts.

Efforts to remedy at least some of the above problems have included the use of pre-shave and after-shave lotions, special whisker-softening lathers or agents, blood coagulants and other medicinal or soothing bio-effecting agents.

Even though shaving comfort can, to some degree, be enhanced by use of one or more of the above-mentioned aids, the requirement that they be applied before, during, or after shaving (because of loss due to evaporation or repeated shaving strokes) lessens the effectiveness of pre-applied aids and post-shaving applications.

In view of the problems listed above with regard to improving wet-shaving technique by addition of one or more agents, it is presently believed that a shavingenhancing agent integrally included with the shaving instrument would provide improved shaving features.

To that end, U.S. Pat. No. 4,170,821 to Booth discloses a solid water-soluble shaving aid incorporated in a disposable razor blade cartridge which gradually dissolves during the act of wet shaving. The shaving aid, in the form of a lubricant, whisker softener, razor cleanser, medicinal agent, cosmetic agent or combination thereof is embedded, dispersed into, formed as an integral component of, or otherwise affixed to the cartridge structure adjacent the shaving edge or edges of single or multiple blades supported therein. The shaving aid can be water-soluble lubricating oil such as microencapsulated silicone oil; water-soluble polyethylene oxide; non-ionic polyacrylamide; and/or a natural polysaccharide derived from plant materials, e.g., guar gum; a depilatory agent; a medicinal agent for killing bacteria or repairing skin condition; a cosmetic agent for softening the skin; or a blood coagulant. The Booth '821 disclosure describes a shaving aid which functions by being deposited on the skin in use through dissolution in water.

U.K. Patent Application G.B. No. 2 024 082 A of Pentney and Calvert discloses a shaving unit having at least one blade and a blade support of moulded polymeric material which provides a skin-engaging cap and guard surfaces. The guard surfaces are formed wholly or in part of a moulded mixture of at least one hydrophobic material and at least one water-leachable hydrophilic polymeric material such that during shaving the water present on the area to be shaved leaches out the hydrophilic material and, consequently, serves as a lubricant. Similar to the Booth '821 disclosure, the surface-affecting agent or component of Pentney and Calvert is deposited in use by dissolution in water. This feature present in both the above disclosures can result in several drawbacks relating to useful shaving unit life, unnecessary shelf-life problems and restrictions on use caused by sensitivity to moisture, possible agent-induced problems including concentration and rate of release, etc. These problems are exacerbated by the use of the lubricant in the presence of an abrasive such as whiskers on the skin which can cause excessive and accelerated deterioration. The lubricant can leave the shaver with a sticky feeling and can lead to itching and irritation. Additionally, lubricant deposited on the skin can reduce the important tensioning and conditioning effect of a guard thereby leading to lower quality shaves.

In U.S. Pat. No. 4,100,309 and U.S. Pat. No. 4,119,094, both to Micklus and Ou-Yang, coated articles are described, and a method for coating suitable substrates with a polyvinylpyrrolidone-polyurethane interpolymer. The coatings are obtained by a two-step procedure using first a solution of isocyanate containing prepolymer and polyurethane followed by a solution of polyvinylpyrollidone. The isocyanate can be modified with chain extenders (diols, etc.) which effectively produce a linear thermoplastic polyurethane in situ. This preparative route yields thin coatings on the order of about 0.0001 in. (2.5 $\mu$m) which are not of uniform composition throughout (two separate layers intermixed at the interface) and are not suitable for the preparation of integral articles, films, foams or matrices with regular and uniform physical and mechanical properties. There is no indication, by Micklus and Ou-Yang to provide a coating lubricious when wet which must withstand abrasive forces while in the lubricious condition.

The prior art seeks primarily to alter shaving friction between skin and skin-engaging surface, by the action of requiring a lubricant to be deposited on the skin.

Thus, it is an object of the present invention to provide a shaving article having a reduced coefficient of friction in the presence of water which is reusable without loss through dissolution of the reduced friction feature.

It is another object of the invention to provide a coating readily applied to a shaving article which provides a reduced coefficient of friction in the presence of water even upon repeated use of the shaving article without loss through dissolution of the lubricating agent.

It is still another object of the invention to provide a lubricious coating to a surface of a shaving article which will substantially adhere to the surface after repeated use, and which will remain functional even after soaking in water for an extended period of time.

Yet another object of the invention is to provide a lubricious coating for a shaving article which can be used for articles made of diverse materials.

Another object of the present invention is to provide a coating for a shaving article which when wetted with water swells and conforms to the skin surface producing a cushioning effect during the act of shaving.

Other objects of the invention will become known to those skilled in the art in view of the present disclosure.

SUMMARY OF THE INVENTION

The present invention is a shaving article for use in wet-shaving which includes at least one blade and a blade support having a skin-engaging portion adjacent to a shaving edge of the blade. The skin-engaging portion is provided in accordance with the present invention with a hydrogel, in which water-soluble polymers are rendered insoluble to prevent their dissolution and separation from the surface of the skin-engaging portion in the presence of water. As a result of the hydrogel being bound to the surface of the skin-engaging portion, the coefficient of friction of the surface of the skin-engaging portion is dramatically reduced in the presence of water.

The hydrogel can be provided to the surface of the skin-engaging portion as a coating, or as a film or sheet. Alternatively, the hydrogel film may be bound to other plastic films or fabrics which are in turn bound to the shaving article. The hydrogel and the plastic films or fabrics can be adhered to the surface of the skin-engaging portion with the assistance of an adhesive such as a polyurethane or an acrylic.

In one embodiment the hydrogel is applied as a coating made of a stable hydrophilic polymer blend which can be adhered to the surface without substantial erosion from the surface in the presence of water during shaving. In this case the polymer blend includes a first polymer component which is an organic solvent-soluble preformed, thermoplastic polyurethane or an isocyanate containing prepolymer and a second high molecular weight polymer component which is hydrophilic. The blend is also capable of withstanding exposure to water during shaving substantially without loss of the hydrophilic polymer component. In one of the most preferred embodiments of the invention the hydrophilic polymer is a poly(N-vinyl lactam) having a molecular weight of from about 100,000 to about 500,000, such as high molecular weight polyvinylpyrrolidone homopolymer. Optionally, the hydrophilic polymer component may be a copolymer of a vinyl lactam with minor amounts of copolymerizable monomers such as alpha-olefins, vinyl chloride, vinylidene chloride, acrylates and methacrylates, vinyl acetate, acrylamide, dimethylacrylamide or vinyl ethers, so long as lubricity is retained in the resultant hydrogel. It is also contemplated that the present invention can include an additional component which can be released such as a bio-effecting agent.

Furthermore with respect to the above-described embodiment, the preformed thermoplastic polyurethane or isocyanate prepolymer can be derived from an aromatic polyisocyanate and a polyether polyol, or an aliphatic polyisocyanate together with a polyether polyol, an aromatic polyisocyanate and a polyester polyol, or from an aliphatic polyisocyanate and a polyester polyol. The polyurethane component can optionally be cross-linked during or subsequent to fabrication of the blend.

In order to effect a coating at the thickness required to provide an excellent shaving article as described in the present invention, it is found that the hydrogel can preferably be applied to the skin-engaging portion or to plastic films or fabrics as a high solids content solution which is quickly dried to form the coating. Preferably, the hydrogel is formed on the skin-engaging portion as a coating having a thickness of from about 0.005 in. to about 0.010 in. (12.5 μm to 250 μm), and most preferably at a thickness of from about 0.0005 in. to about 0.0005 in. (12.5 to 125 μm). The high solids content of the hydrogel solution can be from about 5 to 35 percent by weight and is preferably from about at least 10 percent up to about 25 percent by weight.

Other hydrogels which can be used in the present invention, include polymers and copolymers of cross-linked polyacrylamide, polyhydroxyethylmethacrylate, polyethyleneoxide, acrylic acid, gelatin, modified starches, and functional derivatives of cellulose.

As a result of the present invention, a highly effective and long-lasting lubricious coating can be provided to a shaving article, such as a shaving head, which even after repeated use, retains a smooth draw across the skin of the user. Contrary to what one would expect from the art, in which the hydrophilic component is intentionally dissolved and, consequently, dissipated during use, the present invention by and large retains its lubricious effect during exposure to moisture even after repeated use, for substantially the life of the razor head, being subject only to loss due to abrasion resulting from scraping action against the face of the user.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

A preferred embodiment of the invention has been chosen for purposes of and description and is shown in the drawings wherein:

FIG. 1 is a perspective view of a razor cartridge incorporating invention, and FIG. 2 is a perspective view of a razor cartridge assembly in which lubricity is provided by a film shown detached from the cartridge.

DETAILED DESCRIPTION OF THE INVENTION

Referring to FIG. 1 there can be seen a razor cartridge 10 of the type used in shaving instruments in a wet-shaving system. Conventionally, the razor cartridge 10 includes a blade cap 12 which fits cooperatively with a blade seat 14 to hold one or more blades such as the blades 16 at an angle suitable for shaving. The blade seat 14 is formed with a guard bar 18 for tensioning the skin adjacent the cutting edge of razor blades 16 during shaving. In some well-known cartridges, the guard bar 18 can include ridges 20 which assist in tensioning the skin and preparing the hair growing therefrom for severance by the edge of the blade 16.

Even though the cartridge 10 has been illustrated as being of the twin-blade type, it should be understood that this structure is shown for purposes of illustration only and that the invention described in detail hereinafter is applicable to not only twin-bladed cartridges but equally as well to single or any multiple-bladed shaving cartridge. Furthermore, these basic components of the cartridge 10 are fused, cemented, or otherwise bonded together and hence have become well-known and commonly referred to in the trade as bonded razor blade cartridges.

In the embodiment of the invention illustrated in FIG. 1, the shaving cartridge has a surface 22 immediately adjacent the edge of blades 16, which has been provided with a hydrogel which includes water-soluble polymers bound to the surface to prevent their dissolution so that the coefficient of friction of the skin-engaging unit is reduced in the presence of the water present during the wet-shaving process. Hydrogels used in the present invention can include water-soluble polymers which are cross-linked or otherwise bound so as to prevent their dissolution. If the extent of intermolecular bonding is not too great, compositions can be produced which become extremely lubricious when wet, with frictional coefficients as low as 0.02. Thus, it is preferred that a hydrogel be provided to the surface 22 wherein lubricity can be highly controlled and which also affords considerable durability to withstand the constant abrasion incurred during the shaving process.

The hydrogel can be applied to the shaving cartridge 10 as a coating or as a preformed film or coated substrate, or even as particles or sections embedded in the plastic material comprising the cartridge. In FIG. 2 the lubricity is provided to the cartridge surface by a film or coated substrate 22'.

Furthermore, it is preferred to use an intermediate adhesive layer when the cartridge and hydrogel materials are dissimilar. To this end it has been found that acrylic and polyurethane adhesives/primers are particularly valuable although a wide variety of adhesive/-primers may be useful, including such materials as synthetic and natural rubbers, epoxies, hot melt adhesives, anaerobic adhesives, cyanoacrylates and vinyl and related polymers One particularly useful hydrogel material has been found for use in the present invention which includes a polyvinylpyrrolidone (PVP) and polyurethane interpolymer. Preferably the polyurethane should be an organic solvent-soluble, thermoplastic polyurethane or isocyanate prepolymer which can be taken from a well-known family of resins with extensive literature on the subject, e.g., that contained in *Encyclopedia of Polymer Science and Technology,* Mark, et al. (eds.), Wiley (1969) which is incorporated herein by reference In general, such materials are prepared by the reaction of aromatic and/or aliphatic polyisocyanates with polyester and/or polyether polyols.

Useful polyisocyanates include toluene-2,4-diisocyanate, toluene-2,6-diisocyanate, commercial mixtures of toluene-2,4- and 2,6-diisocyanates, cyclohexylene-1,4-diisocyanate, m-phenylene diisocyanate, 3,3-diphenyl-4,4-biphenylene diisocyanate, 4,4-biphenylene diisocyanate, 1,6-hexamethylene diisocyanate, 1,5-naphthalene diisocyanate, cumene-2,4-diisocyanate, 2,4-diisocyanatodiphenylether, 5,6-dimethyl-1,3-phenylenediisocyanate, 2,4-dimethyl-1,3- phenylene-diisocyanate, 2,4-dimethyl-1,3-phenylene-diisocyanate, 4,4-diisocyanatodiphenylether, 9,10-anthracene diisocyanate, 2,4-diisocyanatotoluene, 1,4-anthracene diisocyanate, 2,4,6-toluene triisocyanate, isophorone diisocyanate and p,p',p'',-triphenylmethane triisocyanate.

Preferred organic solvent-thermoplastic polyurethanes are polytetramethylene ether glycol-diphenylmethane diisocyanate (MDI), polytetramethylene ether glycol tolylene diisocyanate (TDI), polytetramethylene ether glycol-isoferrone isocyanate, poly(1,4-oxybutylene)glycoldiphenylmethane diisocyanate (MDI), poly(1,4-oxybutylene)glycoltolylene diisocyanate (TDI, poly(1,4-oxybutylene) glycolisoferrone isocyanate, polyethylene glycol-diphenylmethane diisocyanate (MDI), polyethylene glycol-tolylene diisocyanate (TDI), polyethylene glycol-isoferrone isocyanate, polypropylene glycoldiphenylmethane diisocyanate (MDI), polypropylene glycol-tolylene diisocyanate (TDI), polypropylene glycol-isoferrone isocyanate, polycaprolactone-diphenylmethane diisocyanate (MDI), polycapro-lactone-tolylene diisocyanate (TDI), polycaprolactoneisoferrone isocyanate, polyethylene adipate-diphenylmethane diisocyanate (MDI), polyethylene adipate-tolylene diisocyanate (TDI), polyethylene adipate-isophorone isocyanate, polytetramethylene adipate-diphenylmethane diisocyanate (MDI), polytetraethylene adipate-tolylene diisocyanate (TDI), polytetramethylene adipate-isoferrone isocyanate, polyethylenepropylene adipate-diphenylmethane diisocyanate (MDI), polyethylene-propylene adipate-tolylene diisocyanate (TDI), and polyethylene-propylene adipate-isophorone isocyanate polyurethanes.

Although the polyurethanes useful in blends with poly N-vinyl lactams are essentially linear in order to provide solubility and thermoplasticity, they can be crosslinked following blending with the poly(N-vinyl lactam) component, e.g., by adding a sufficient quantity of cross-linking agent to a solvent solution of the polymers or by incorporating the cross-linking agent into the melt-blended polymer mixture while it is still in the plastic state. Examples of cross-linking agents which can be utilized for this purpose are isocyanates, polycarboxylic acids, peroxide and organotitanates For coating or casting purposes, it is advantageous to combine the water soluble polymer and the cross-linking agent together in a solvent or mixture of solvents in which the combined polymers are present in a concentration from 1 to 99 percent by volume, and preferably from 10 to 40 percent. The water soluble polymer and complexing or alloying agent should be present in a ratio of 1:10 to 10:1, preferably from 2:1 to 5:1, respectively.

Useful polyester polyols include those obtained from the condensation of polycarboxylic acids, preferably dicarboxylic acids, such as adipic, sebacic, phthalic, isophthalic, terephthalic, oxalic, malonic, succinic, maleic, cyclohexane-1,2-dicarboxylic, cyclohexane-1,4-dicarboxylic, polyacrylic, naphthalene-1,2-dicarboxylic, fumaric, itaconic, etc., with polyalcohols, preferably diols, such as ethylene glycol, diethylene glycol, pentaglycol, glycerol, sorbitol, triethanolamine, di(betahydroxyethyl)ether, etc., and/or amino-alcohols such as ethanolamine, 3-aminopropanol, 4-aminopropanol, 5-aminopentanol- 1,6-aminohexanol, 10-aminodecanol, 6-amino-5-methyl-hexanol-l, p-hydroxymethylbenzylamine, etc. Polyesters derived from ring-opening/condensation of lactones with polyfunctional compounds such as any of the aforementioned polyalcohols can also be used in providing the organic solvent-soluble, thermoplastic polyurethane component of the subject polymer blends.

The term "poly(N-vinyl lactam)" as used herein shall be understood to include homopolymers and copolymers of such N-vinyl lactams as N-vinylpyrrolidone, N-vinylbutyrolactam, N-vinylcaprolactam, and the like, as well as the foregoing prepared with minor amounts, for example, up to about 20 weight percent, of one or a mixture of other vinyl monomers copolymerizable with the N-vinyl lactams. Of the poly(N-vinyl lactams), the polyvinylpyrrolidone (PVP) homopolymers are preferred. Furthermore, it has been found that PVP having a high molecular weight, e.g., from about 100,000 to about 500,000 work particularly well in that they readily imbibe water without loss from dissolution, adhere well to the surface, and withstand abrasion extremely well.

The polyurethane and poly(N-vinyl lactam) components of the blend can be combined employing conventional melt blending techniques and apparatus, e.g., a two-roll heated mill, helical screw extruder, etc., or, if desired, the components can be combined by dissolving them in solvent which is subsequently evaporated to yield the blend. If the latter procedure is selected, the choice of solvent is important. Thus, the solvent must be capable of dissolving both polymer components in a single-phase solution and the relative volatilities must be such that at no point during evaporation and drying, the resulting mixture will tend to precipitate either polyurethane, poly(N-vinyl lactam) or an association complex of these polymers which may have different solubility characteristics than either material by itself. Solvents which are suitable include ethyl lactate, diacetone alcohol, methylene chloride, trichloroethylene, N-methyl pyrrolidone and mono and di-ethylene glycol ethers. Other solvents can be added to accelerate drying, reduce solvency toward particular substrates, etc., provided the aforestated conditions are met.

The blends of this invention can also be prepared from aqueous polyurethane dispersions where a coalescing solvent of lower volatility than water and/or electrostatic attraction from ionic species on dispersed macromolecules aids in compatibilizing the individual polymers during the final stages of drying. Examples of such a solvent include N-methyl(pyrrolidone), dimethyl formamide, diacetone alcohol and various mono- and diethylene glycol esters or ethers.

The blends can contain from about 10 to about 50 weight percent, and preferably from about 15 to about 35 weight percent, of polyurethane, the balance being made up of the poly(N-vinyl lactam) component Minor quantities, for example, up to about 20 weight percent, of one or a mixture of other compatible polymers can be incorporated into the blends, e.g., any of the polymers disclosed in General Aniline & Film Corporation Technical Bulletin 7583-033 referred to above.

In the event the blend is applied as a coating, the solids content should be relatively high in order to effect rapid drying and, concomitantly, providing a thick coating. This is important in view of the abrasion which occurs during shaving. Although in the art it was known to provide thin coatings of polyurethane/PVP interpolymers to different devices such as catheters, condoms, etc., there has been no indication or suggestion that a thick coating of hydrogel which resists release from the surface and which resists dissolution in the presence of water during wetshaving can be achieved.

Furthermore, different types of additional materials can be incorporated into the polymer blends herein including organic and inorganic salts, alcohols, amines, acids, polymer latices, resin or wax dispersions, fillers, fibers, cellulosics, surfactants, pigments, dyes, enzymes, proteins, chelates, thickeners, stabilizers, dyes, fragrances, and so forth. The blends of this invention are especially useful as carriers for a wide variety of releasable materials including biologically active substances having curative or therapeutic value, such as local anesthetics, analgesics, antiinflammatory agents, antibacterials, antifungals, sympathomimetic agents, transcutaneously-delivered cardiovascular agents, diuretics, antiparasitic, antitumor, and hypoglycemic agents, and so forth.

In the form of a sheet or film or as a coating, or as a coated film these blends can be combined and adhered to a virtually unlimited variety of substrates including metal and resin foils, woven and non-woven webs of natural and synthetic fibers, etc.

Examples of other hydrogel materials which can, under certain conditions, produce highly lubricious compositions include polymers and co-polymers of crosslinked polyacrylamide, polyhydroxyethyl methacrylate, polyethylene oxide, acrylic acid, gelatin, modified starches and various functional cellulose derivatives. The current invention applies only to those effective water insoluble forms of these materials which exhibit significantly reduced surface friction when wet, with co-efficients of friction limited to about 0.10 or less.

Polyurethane adhesives have proven particularly valuable for adhering hydrogels to shaving cartridges. Other adhesives which may be suitable include cyanoacrylates, hot melts, heat and solvent activated coatings and certain water-resistant pressure sensitives. A well-defined interface between hydrogel and adhesive should be avoided as this is more susceptible to delamination when the hydrogel is in a state swollen by water. Polymer chain entanglement or use of water impermeable barrier films provide water-resistant bonds.

The following examples are further illustrative of the blends of this invention.

EXAMPLE 1

To a mixture of 75 g diacetone alcohol and 25 g methyl ethyl ketone is added 4 g polyvinylpyrrolidone (Kollidon 90, BASF Corp.) and 2 g linear polyurethane (Estane 5703, B. F. Goodrich Co.). The resulting solution when applied to such substrates as vinyl, epoxy and polyurethane resins and permitted to dry forms a highly durable coating which is slippery when wet (coefficient of friction 0.05). Continuous contact of the coated substrates with water for six months does not degrade the coating or diminish its lubricity to any appreciable extent.

The hydrogel coated substrates can be cut to size to fit the cartridge and adhered using a cyanoacrylate adhesive. Variously decorated and colored substrates may be used, such as vinyl, polyester and urethane which can provide both a functional and decorative strip to the cartridge.

EXAMPLE 2

To 72 g of water and 10 g N-methylpyrrolidone is added 10 g of polyvinylpyrrolidone (Kollidon 90, BASF Corp.) and 8 g of linear polyurethane aqueous dispersion (Neorez R940, Polyvinyl Chemical Industries). Films cast from the resulting viscous dispersion are lubricious when wet (coefficient of friction 0.04) and imbibe water forming elastic, transparent films useful when adhered to a razor blade cartridge.

EXAMPLE 3

Films cast as in Example 2 and containing 2% chlorohexidine acetate (w/w/ based on polymer) exhibited long acting bactericidal action against Staph. aureus in humid environments. Other substances where were successfully combined with the blends include cephalosporin, ampicillin, oxytetracycline, metaproterenol sulfate, salicylic acid and phenolphthalein.

EXAMPLE 4

To 25 g ethyl lactate and 75 g methyl ethyl ketone is added 6 g polyvinlypyrollidone (Luviskol 90, BASF Corp.) and, after dissolution, 2 g 34D isocyanate prepolymer (Synthetic Surfaces, Inc.). Coatings or films deposited from the resulting viscous solution are highly lubricious when wet, with coefficients of friction ranging from 0.03 to 0.05. Shaving articles treated with the solution can be soaked in water indefinitely without losing lubricity or significantly leaching soluble polymers into the water.

Thus, while there have been described what are presently believed to be the preferred embodiments of the present invention, those skilled in the art will realize that changes and modification may be made thereto without departing from the spirit of the invention, and it is intended to claim all such changes and modifications as fall within the true scope of the invention.

What is claimed is:

1. A shaving article comprising at least one blade, a blade support and a skin-engaging portion adjacent a shaving edge of said blade, said skin-engaging portion provided with a hydrogel comprising a water soluble polymer rendered insoluble so as to prevent dissolution of the polymer, whereby the coefficient of friction of said skin-engaging portion is reduced in the presence of water.

2. The shaving article of claim 1 wherein said hydrogel is provided to said skin-engaging portion as a coating having a thickness of from about 0.0005 in. to about 0.010 in. (12.5 to 250 μm).

3. The shaving article of claim 2 wherein said coating is a stable hydrophilic polymer blend which can be adhered to a surface without detaching from said surface in the presence of water during shaving, said blend comprising a first polymer component which is an organic solvent-soluble, preformed, thermoplastic polyurethane and a second high molecular weight polymer component which is hydrophilic, said blend being lubricious when wet and capable of withstanding exposure to water during shaving substantially without loss of said hydrophilic polymer component.

4. The shaving article of claim 3 wherein said polyurethane component is cross-linked during or subsequent to fabrication of the blend.

5. The shaving article of claim 3 wherein the polyurethane is derived from an aromatic polyisocyanate and a polyether polyol.

6. The shaving article of claim 3 wherein the polyurethane is derived from an aliphatic polyisocyanate and a polyether polyol.

7. The shaving article of claim 3 wherein the polyurethane is derived from an aromatic polyisocyanate and a polyester polyol.

8. The shaving article of claim 3 wherein the polyurethane is derived from an aliphatic polyisocyanate and a polyester polyol.

9. The shaving article of claim 3 wherein said hydrophilic polymer is a poly(N-vinyl lactam) having a molecular weight of from about 100,000 to about 500,000.

10. The shaving article of claim 9 wherein said poly(N-vinyl lactam) is a water soluble polyvinylpyrrolidone homopolymer.

11. The shaving article of claim 9 wherein the poly(N-vinyl lactam) is a poly(N-vinyl caprolactam) homopolymer.

12. The shaving article of claim 9 wherein the poly(N-vinyl lactam) is a copolymer with at least one other monomer.

13. The shaving article of claim 12 wherein said poly(N-vinyl lactam) component is a copolymer of at least one monomer selected from the group consisting of alphaolefin, vinyl chloride, vinylidene chloride, hydroxyethylmethacrylate, acrylic acid, methacrylic acid, vinyl acetate, vinyl alcohol and vinyl ether.

14. The shaving article of claim 2 which comprises an adhesive between said hydrogel coating and said surface of said skin-engaging portion which enhances the binding of said hydrogel to said skin-engaging portion.

15. The shaving article of claim 14 wherein said adhesive is selected from a material selected from the group consisting of acrylics and polyurethane.

16. The shaving article of claim 14 wherein said adhesive is applied as a precoating and dried before application of said hydrogel.

17. The shaving article of claim 2 wherein said hydrogel is applied as a high solids-content solution and dried on said skin-engaging portion to form said coating.

18. The shaving article of claim 17 wherein said solids content of said solution is from about 5–35% by weight.

19. The shaving article of claim 18 wherein said solids content is from about 10–25% by weight.

20. The shaving article of claim 1 wherein said hydrogel is provided to the surface of said skin-engaging portion as a film or sheet having a thickness of from about 0.0005 in. to about 0.005 in. (12.5 to 125 μm).

21. The shaving article of claim 20 wherein said film comprises a preformed stable hydrophilic polymer blend which can be adhered to said surface substantially without detaching from said surface in the presence of water during shaving comprising a first polymer component which is an organic solvent-soluble, preformed, thermoplastic polyurethane and a second high molecular weight polymer component which is hydrophilic, said blend capable of withstanding exposure to water during shaving substantially without loss of said hydrophilic polymer component.

22. The shaving article of claim 21 which further comprises an adhesive between said film or sheet and said surface of said skin-engaging portion which enhances the binding therebetween.

23. The shaving article of claim 2 wherein said hydrogel is selected from the group consisting of polymers and co-polymers of cross-linked polyacrylamide, polyhydeoxyethyl, methacrylate, polyethylene oxide, acrylic acid, gelatin, modified starches, and functional derivatives of cellulose.

24. The shaving article of claim 1 wherein said hydrogel includes one or more additional ingredients.

25. The shaving article of claim 24 wherein said additional ingredient is releasable from said hydrogel but is non-lubricating.

26. The shaving article of claim 25 wherein said releasable material is a bio-effecting or body treating material.

27. The shaving article of claim 1 wherein said hydrogel is provided to the surface of said skin-engaging portion as a coating on plastic film or fabric which is in turn adhered to said shaving article.

28. A shaving article comprising at least one blade, blade support and a skin-engaging portion adjacent a shaving edge of the blade, said skin-engaging portion provided with a hydrogel comprising a water soluble polymer rendered insoluble so as to prevent dissolution of the polymer whereby the coefficient of friction of said skin-engaging portion is reduced in the presence of water, said hydrogel provided to said skin-engaging portion as a coating having a thickness of from about 0.0005 in to about 0.010 in. (12.5 μm to 250 μm).

* * * * *